US007604144B2

(12) United States Patent
Kuehneman

(10) Patent No.: US 7,604,144 B2
(45) Date of Patent: Oct. 20, 2009

(54) SHEET PRODUCT DISPENSER WITH RETENTION MEMBER

(75) Inventor: Bret A. Kuehneman, Neenah, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 135 days.

(21) Appl. No.: 11/841,372

(22) Filed: Aug. 20, 2007

(65) Prior Publication Data

US 2009/0050647 A1 Feb. 26, 2009

(51) Int. Cl.
*B65H 1/00* (2006.01)

(52) U.S. Cl. ..... 221/52; 221/46; 221/54; 206/494

(58) Field of Classification Search ..... 206/494, 206/499, 233, 581; 211/52, 53, 56, 45, 46
See application file for complete search history.

(56) References Cited

U.S. PATENT DOCUMENTS

| | | | | | |
|---|---|---|---|---|---|
| 1,550,544 | A | * | 8/1925 | Hansen | 211/51 |
| 1,583,293 | A | * | 5/1926 | Horwitt | 211/51 |
| 1,587,463 | A | * | 6/1926 | Arms | 221/52 |
| 1,647,000 | A | | 10/1927 | Hansen | |
| 1,665,057 | A | * | 4/1928 | Genest | 221/46 |
| 1,916,615 | A | | 7/1933 | Haveles | |
| 1,969,220 | A | | 8/1934 | Ingram | |
| 2,202,300 | A | | 5/1940 | Posnack | |
| 3,106,314 | A | * | 10/1963 | Spears | 221/35 |
| 3,228,556 | A | * | 1/1966 | Nonestied | 221/279 |
| 3,442,393 | A | * | 5/1969 | Koppelman | 211/13.1 |
| 3,966,103 | A | | 6/1976 | Abrams | |
| 4,753,369 | A | | 6/1988 | Morrison | |
| 4,807,764 | A | * | 2/1989 | Bellin | 211/94.01 |
| 5,100,020 | A | * | 3/1992 | Petterson et al. | 221/45 |
| 5,392,923 | A | | 2/1995 | Hassard et al. | |
| D396,171 | S | | 7/1998 | Conway | |
| 6,070,756 | A | * | 6/2000 | Dodge et al. | 221/52 |
| 6,357,624 | B1 | * | 3/2002 | Brown | 221/312 A |
| 6,457,605 | B2 | | 10/2002 | Coleman | |
| 6,899,251 | B2 | | 5/2005 | Christensen et al. | |
| 7,048,143 | B2 | * | 5/2006 | Sanders et al. | 221/46 |
| 2006/0163268 | A1 | | 7/2006 | Kuehneman et al. | |

OTHER PUBLICATIONS

James L. Throne, Thermoforming, 1987, pp. 13-38, Hanser Publishers, Munich.

* cited by examiner

*Primary Examiner*—Mickey Yu
*Assistant Examiner*—Chun Cheung
(74) *Attorney, Agent, or Firm*—Joel T. Charlton

(57) ABSTRACT

A napkin dispenser includes a housing defining a vertically extending dispensing magazine for receiving a stack of horizontally disposed sheet products as well as a dispensing opening vertically extending along the dispensing magazine such that edges of napkins horizontally disposed in the magazine are exposed for dispensing through the dispensing opening. An internal guide channel extends upwardly from the dispensing magazine and receives a guide member of a sheet product retention member slidingly mounted in the housing.

10 Claims, 4 Drawing Sheets

SHEET PRODUCT DISPENSER WITH RETENTION MEMBER

BACKGROUND

The present disclosure generally relates to sheet product dispensers, and more particularly, to napkin dispensers with retaining means for a vertical stack of napkins.

Napkin dispensers with weights or like components for retaining napkins in a stack are known in the art. There is shown for example in U.S. Pat. No. 4,753,369 to Morrison a napkin dispenser including a container having an open top and front. Opposed side walls of the container receive a cover that is upwardly and downwardly moveable under the influence of gravity. See also U.S. Pat. No. 6,457,605 to Coleman which discloses a napkin dispenser provided with a casing and a dispenser assembly. The dispenser assembly includes a roller and a gravity-biased follower which moves upwardly and downwardly in an inclined groove.

A number of article dispensers employ a weight such as a rail or plate which is moveable upwardly and downwardly and guided by vertical bars or slots, for example. See U.S. Pat. No. 5,392,923 to Hassard et al.; U.S. Pat. No. 4,807,764 to Bellin; U.S. Pat. No. 3,966,103 to Abrams; U.S. Pat. No. 2,202,300 to Posnack which discloses a holder for desk paraphernalia; U.S. Pat. No. 1,583,293 to Horwitt; as well as U.S. Pat. No. 1,647,000 to Hansen.

Napkin dispensers have been provided with various features for holding condiments in addition to napkins. In this regard, see U.S. Pat. No. 3,442,393 to I. J. Koppelman; U.S. Pat. No. 3,106,314 to Spears; U.S. Pat. No. 1,969,220 to Ingram; U.S. Pat. No. 1,916,615 to Haveles, as well as U.S. Design Pat. Des. 396,171 to Conway.

Despite advances in the art, existing dispensers with gravity devices for retaining napkins tend to be suitable for limited amounts of product only and are often difficult to re-load. Ready access to relatively large volumes of product is needed in casual-dining commercial settings and the like where rapid distribution is an important consideration. Likewise, as is appreciated from the foregoing references, sufficient protection from drafts and contamination from spills or dust is often lacking in products intended for home use.

Accordingly, a continual need exists for improved sheet product dispensers.

BRIEF SUMMARY

Disclosed herein are sheet product dispensers.

In one embodiment, a sheet product dispenser comprises (a) a housing defining: (i) a vertically extending dispensing magazine for receiving a stack of horizontally disposed sheet products; (ii) a dispensing opening vertically extending along the dispensing magazine such that edges of sheet products horizontally disposed in the magazine are exposed for dispensing through the dispensing opening; (iii) an internal guide channel extending upwardly from the dispensing magazine; and (b) a sheet product retention member slidingly mounted in the housing adapted to rest upon the stack of sheet products and move downwardly under the influence of gravity as the sheet product stack is depleted, the sheet product retention member including: (i) a platform; and (ii) a guide member extending upwardly from the platform and residing in the guide channel, wherein the guide member and guide channel are configured to cooperate to guide upward and downward motion of the sheet product retention member.

In one embodiment, a sheet product dispenser comprises: (a) a housing defining: (i) a vertically extending dispensing magazine having a generally rectangular cross-section, a pair of magazine sidewalls and a bottom magazine wall for receiving a stack of horizontally disposed sheet products; (ii) a dispensing opening extending vertically upwardly from the bottom magazine wall extending between the sidewalls of the magazine; (iii) a guide channel extending upwardly from the dispensing magazine and; (iv) a storage bin adjacent the guide channel of the housing, wherein the guide channel is located rearwardly with respect to the storage bin and separated therefrom by an inclined wall which extends upwardly with respect to the dispensing magazine and rearwardly toward a back wall of the dispenser; and (b) a sheet product retention member slidingly mounted in the housing adapted to rest upon the stack of sheet products and move downwardly under the influence of gravity as the sheet product stack is depleted the sheet product retention member including: (i) a generally rectangular platform; and (ii) a tapered guide member extending upwardly from the platform having a rearwardly inclined front surface residing in the guide channel of the housing, wherein the tapered guide member and guide channel are configured to cooperate to guide upward and downward motion of the sheet product retention member.

A sheet product dispenser comprises (a) a housing defining (i) a vertically extending dispensing magazine having a generally rectangular cross-section defining an internal cross section perimeter and including a pair of magazine sidewalls and a bottom magazine wall for receiving a stack of horizontally disposed sheet products; (ii) a dispensing opening extending vertically upwardly from the bottom magazine wall between the sidewalls of the magazine; (iii) a guide channel extending upwardly from the dispensing magazine; (b) a sheet product retention member slidingly mounted in the housing adapted to rest upon the stack of sheet products and move downwardly under the influence of gravity as the sheet product stack is depleted the sheet product retention member including: (i) a generally rectangular platform having a perimeter substantially identical to the magazine internal cross section perimeter of the dispensing magazine; and (ii) a guide member extending upwardly from the platform and residing in the guide channel of the housing, wherein the guide member and guide channel are configured to cooperate to guide upward and downward motion of the sheet product retention member.

The above described and other features are exemplified by the following Figures and detailed description.

BRIEF DESCRIPTION OF THE DRAWINGS

Referring to the exemplary drawings wherein like elements are numbered alike in the several Figures.

DETAILED DESCRIPTION

Figure 1:
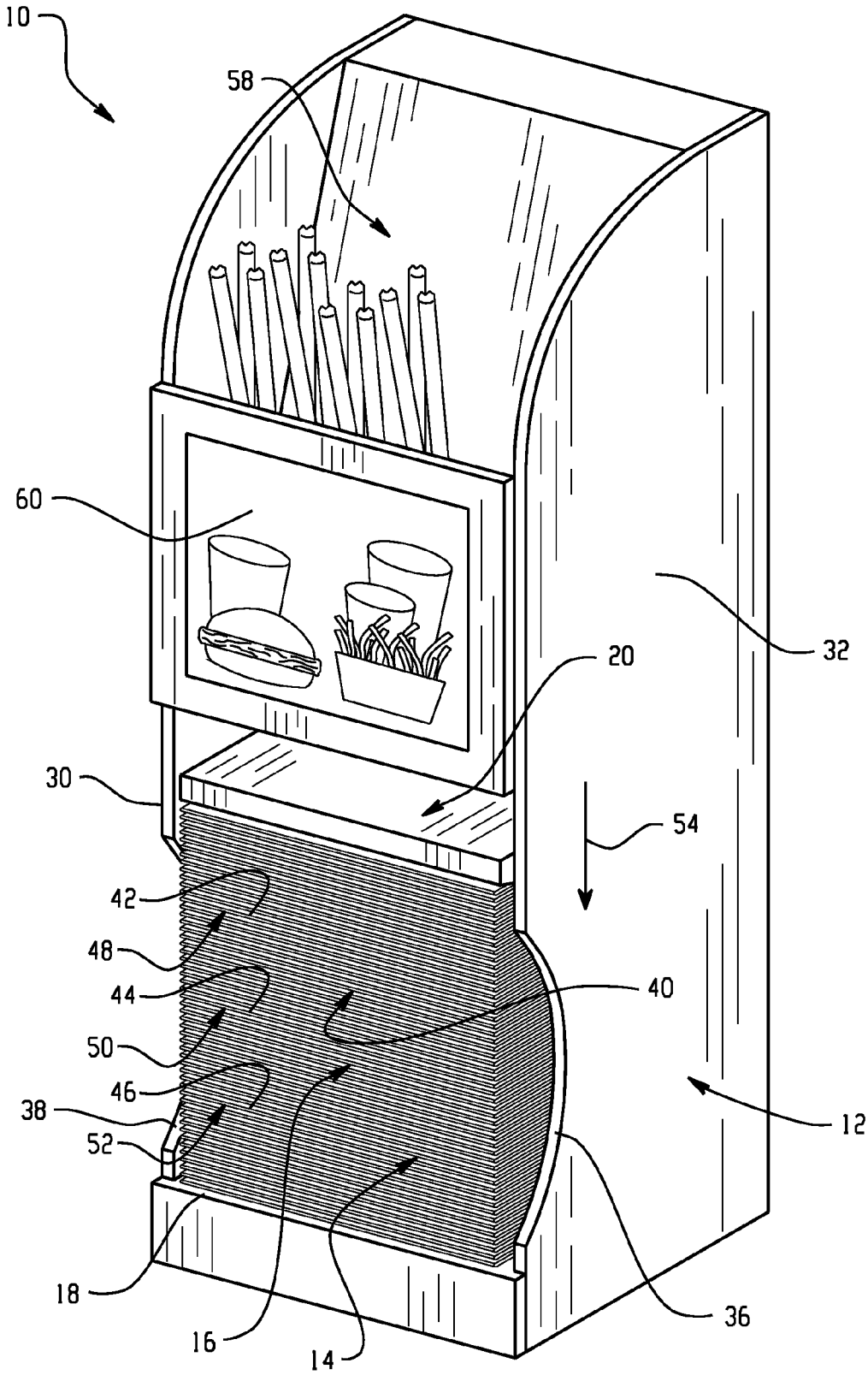
FIG. 1 is a view in perspective and elevation of an embodiment of a sheet product dispenser with retention member.

Disclosed herein is a sheet product dispenser with retention member. While embodiments are discussed in relation to a napkin dispenser for convenience in discussion, it is to be understood that this disclosure can be modified for use with other sheet products.

The term "sheet products" is inclusive of natural and/or synthetic cloth or paper sheets. Further, sheet products can include both woven and non-woven articles. Examples of sheet products include, but are not limited to, wipers, napkins, tissues, and towels.

Referring generally to FIGS. 1 through 8 there is shown a dispenser 10 having a housing 12, which defines a vertically extending dispensing magazine 14 as well as a dispensing opening 16 extending vertically from a bottom wall 18 of the dispensing magazine 14. There is further provided a retention member 20, which is hereinafter interchangeably referred to as a retaining anvil 20. The term "anvil" as used herein is not intended to be limiting in terms of the overall shape of the retention member; that is, the retaining anvil includes anvil and non-anvil shapes that have a size, shape, and weight sufficient for retaining napkins in the dispenser 10.

In one embodiment, the retaining anvil 20 includes a generally rectangular platform 22 as well as a guide member 24 extending upwardly from platform 22 and residing in a guide channel 26. The shape of the platform is not limiting and includes any shape that provides sufficient contact with the napkins to be used in the dispenser 10. Suitable shapes include, but are not limited to, circular, square, and polygonal. The guide member 24 and guide channel 26 are configured to cooperate to guide upward and downward motion of retaining anvil 20. In this respect, the dispensing magazine 14 has an internal cross section perimeter 28 (see FIG. 7) defined by magazine side walls 30, 32, and magazine backwall 34 having a perimeter approximated by the internal perimeter of bottom wall 18. Dispensing opening 16 is at one side of the internal cross section perimeter of the dispensing magazine 14; that is to say the internal magazine perimeter extends along side walls 30, 32 and backwall 34 and is essentially the internal perimeter of bottom wall 18 of dispensing magazine 14. The internal cross section perimeter is essentially uniform with height. Side walls 30, 32 define cutaways 36, 38 to facilitate loading and removal of napkins from dispenser 10. In this regard, a napkin stack 40 is disposed in dispensing magazine 14 in a horizontal configuration such that edges 42, 44 and 46 of napkins 48, 50 and 52 are exposed for dispensing through dispensing opening 16. The retaining anvil 20 is slidingly mounted in the housing so as to rest upon the stack of napkins, thereby securing the stack. The retaining anvil 20 moves downwardly in direction 54 under the influence of gravity as the stack is depleted and is raised when reloading the dispenser 10.

In the embodiment shown, the internal cross section perimeter of the dispensing magazine 14 and a perimeter 56 (footprint) of the retaining anvil 20 are substantially identical. There is of course provided some clearance between the side walls and back of the dispenser 10 and the napkin retaining anvil 20 such that the retaining anvil 20 may freely move upwardly and downwardly in the housing 12. In this regard, a clearance of about 1/16 inch to about 1/4 inch may be provided, if so desired.

In one embodiment, there is further defined by the housing a storage bin 58 located atop dispensing magazine 14 which has a front panel 60, which may be used for displaying advertising or other material as shown. Storage bin 58 is suitably sized to accommodate condiments such as salt, pepper, ketchup, mustard and the like, as well as dining utensils including spoons, forks, straws and so forth. The storage bin 58 may contain partitions (not shown) for separating various condiments and the like.

Figure 6:
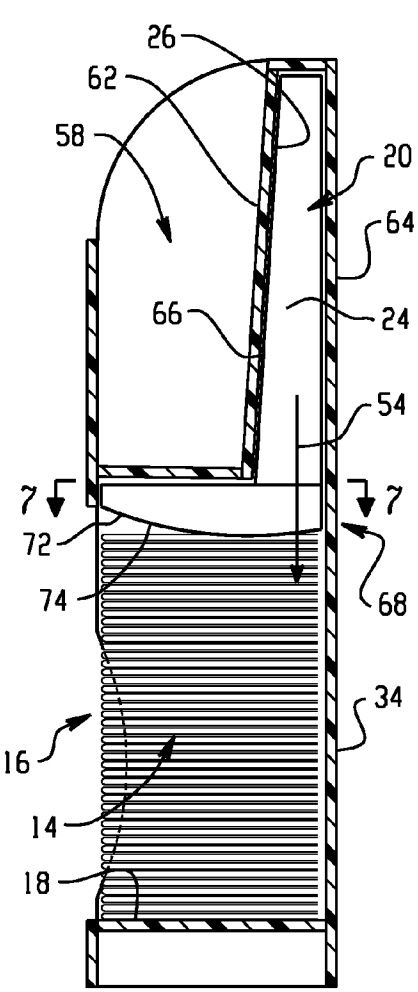
FIG. 6 is a view in section and elevation of the dispenser of FIGS. 1 through 5 wherein the retention member is shown in an uppermost position.
Figure 4:
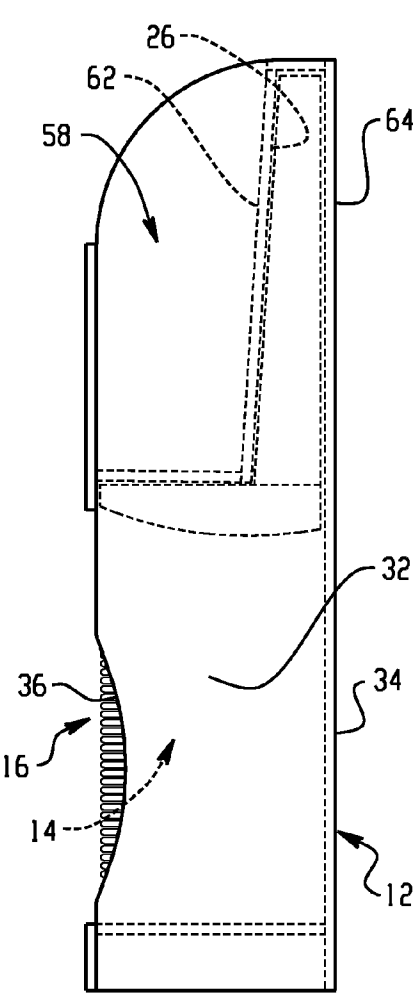
FIG. 4 is a side view in elevation of the dispenser of FIGS. 1, 2 and 3.
Figure 2:
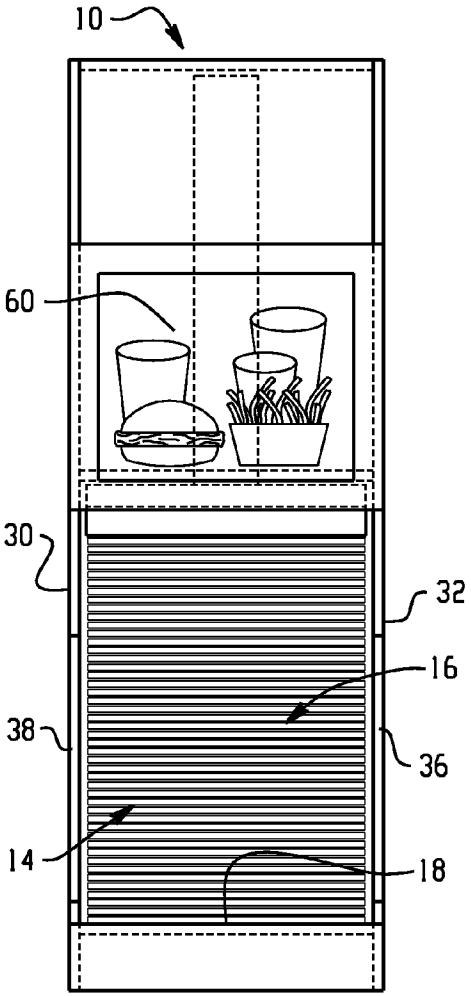
FIG. 2 is a front view in elevation of the dispenser of FIG. 1.
Figure 3:
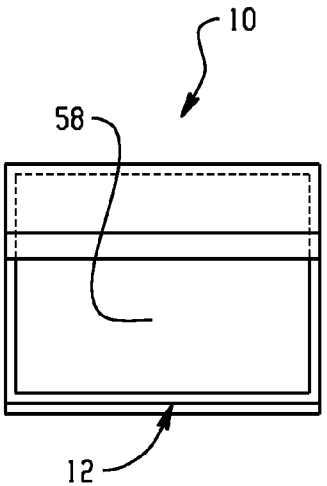
FIG. 3 is a top view of the dispenser of FIGS. 1 and 2.
Figure 8:
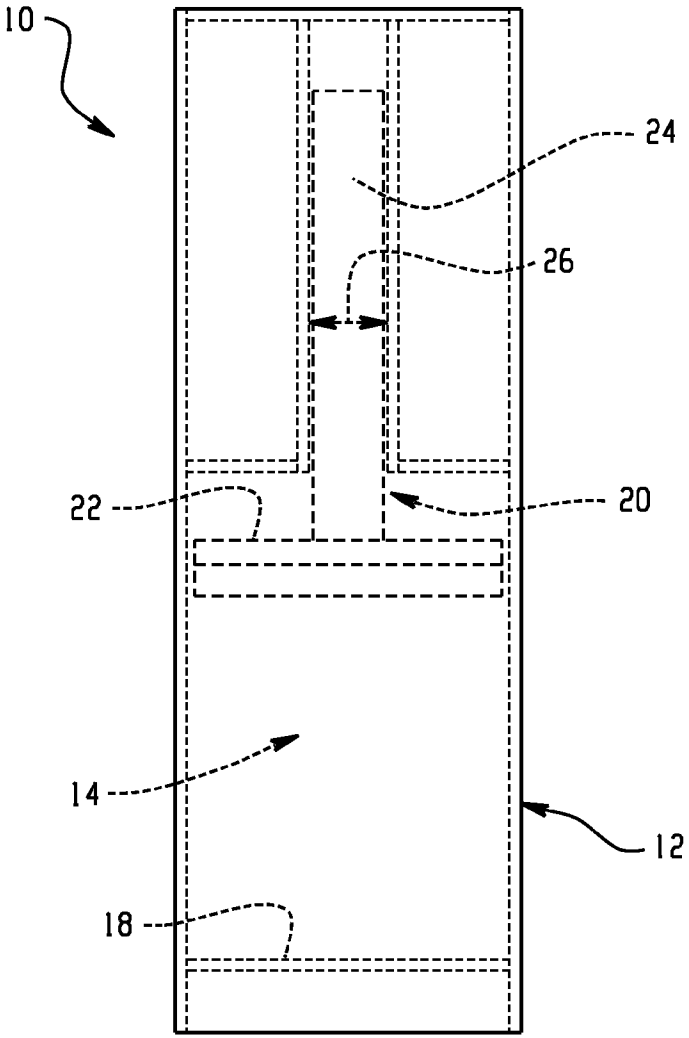
FIG. 8 is a rear view in elevation illustrating the location of a guide channel of the dispenser.
Figure 7:
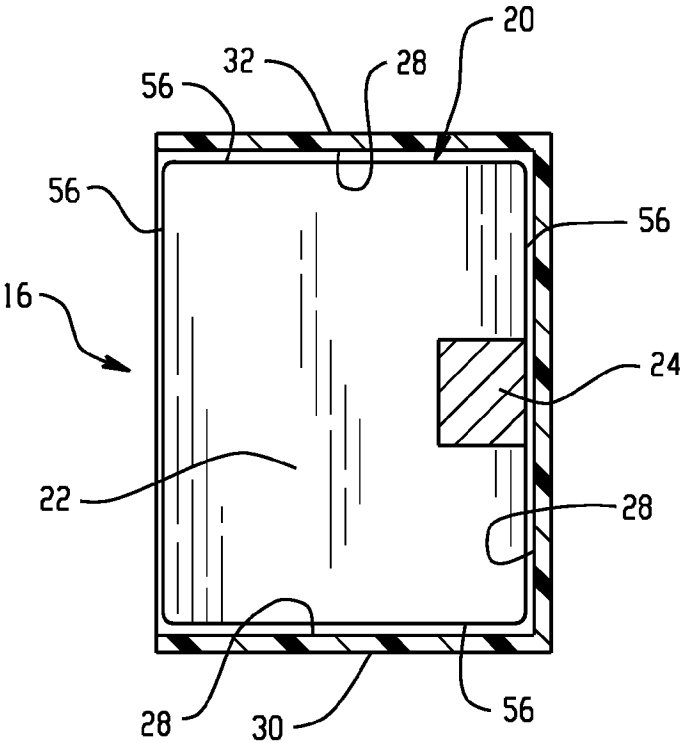
FIG. 7 is a view in section along line 7-7 of FIG. 6 illustrating the internal cross section perimeter of the dispensing magazine and the perimeter of the retention member.

Referring to FIGS. 5 through 8, it is appreciated that storage bin 58 is separated from guide channel 26 by an inclined wall 62. The inclined wall 62 extends rearwardly towards back wall 64 of housing 12. Guide member 24 has a rearwardly inclined front surface 66 in order to mate with guide channel 26 in an uppermost position 68 shown in FIG. 6. The geometry illustrated has particular advantages in that the guide member may be installed in the housing or removed from the housing without disassembling the housing and without disassembling the retaining anvil 20. The guide member 24 has a cross section that decreases with increasing height from the platform 22 such that it may be readily inserted into the guide channel 26. The guide channel 26 and guide member 24 have substantially identical shape such that they mate in the uppermost position as seen in FIGS. 6 and 8. An added advantage of the housing geometry is that the inclined surfaces provide a positive mold draft for thermoforming or injection molding to facilitate construction of the dispenser. In this regard, in one embodiment, injection molding and/or thermoforming can be employed for at least portions of the housing and retaining anvil 20 from a thermoplastic material.

Thermoplastic materials are readily available and include, but are not limited to, high impact polystyrene resins (HIPS); polystyrene resins; acrylonitrile-butadiene-styrene (ABS) resins; polyacrylic resins; polycarbonate resins; polystyrene resins; styrene-acrylic copolymer resins and so forth. The compositions may be filled or unfilled and optionally include additives such as impact modifiers, stabilizers, mold release agents and the like.

Typical thermoforming operations involve positioning of a sheet of thermoplastic material having an accurately controlled temperature into a pneumatically actuated forming station whereby the article's shape is defined by the mold, followed by trimming and regrind collection as is well known in the art. Still other alternative arrangements include the use of drape, vacuum, pressure, free blowing, matched die, billow drape, vacuum snap-back, billow vacuum, plug assist vacuum, reverse draw with plug assist, pressure bubble immersion, trapped sheet, slip, diaphragm, twin-sheet cut sheet, twin-sheet roll-fed forming or any suitable combinations of the above. Details are provided in J. L. Throne's book, *Thermoforming*, published in 1987 by Hanser Publishers. Pages 21 through 29 of that book are incorporated herein by reference.

It is to be understood that the housing and retaining anvil 20 can be made by any suitable material to provide the desired strength and provide ease in manufacturing. While thermoplastic materials where discussed above in detail for their ease and low cost in manufacturing, suitable materials also include, metals, plastics (including thermoset resins), cellulose (e.g. cardboard and wood), and the like.

Figure 5:
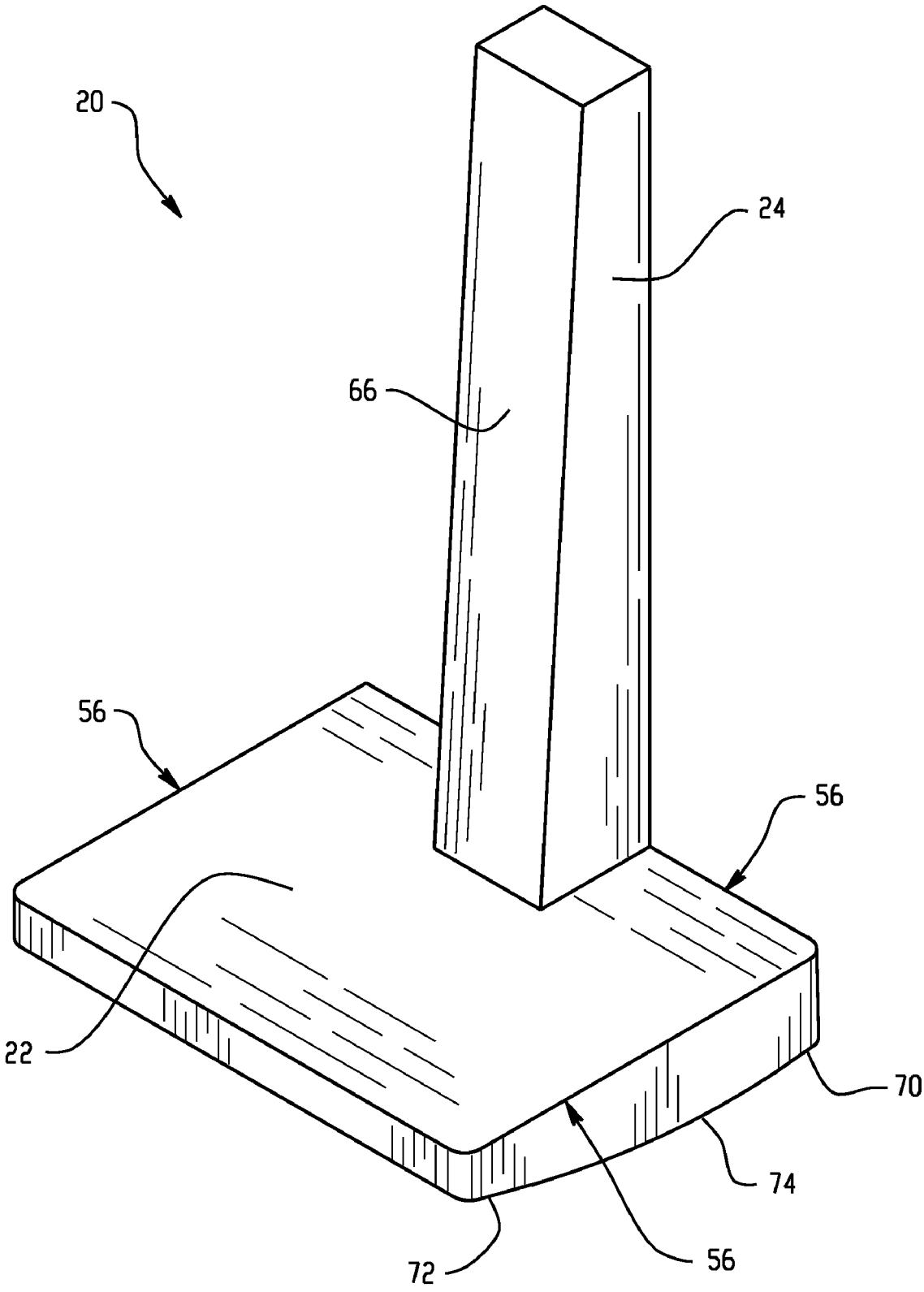
FIG. 5 is a view in perspective of the retention member of the dispenser of FIGS. 1 through 4.

Referring particularly to FIGS. 1 and 5, it is seen that platform 22 has a lower surface 70 with a raised portion 72 which is disposed adjacent to dispensing opening 16 such that the raised portion facilitates dispensing of napkins from stack 40. In one embodiment, the platform 22 has an arcuate profile 74 as shown throughout the various figures. The platform 22 and dispensing magazine 14 are sized such that they cooperate to control yaw, (that is, rotation) of the retaining anvil 20 as it moves upwardly and downwardly in the dispensing magazine 14. The guide channel of the housing and the guide member of the retaining anvil 20 are also sized to cooperate to control yaw of the retaining anvil 20 as it moves upwardly and downwardly. The guide channel of the housing and the guide member of the retaining anvil 20 are also sized to cooperate to control attitude (that is, horizontal inclination) of the platform 22 as it moves upwardly and downwardly in the dispensing magazine.

In one embodiment, a suitable construction as is illustrated in FIGS. 1 through 8 is wherein the vertically extending dispensing magazine has a generally rectangular cross section, a pair of magazine side walls and a bottom magazine side wall for receiving a stack of horizontally disposed napkins. The bottom wall likewise defines the internal cross section perimeter of the dispensing magazine and is typically sized to approximate the panel size, that is, the folded size of the napkins to be placed thereon. The dispensing magazine has a height of 9-10 inches or so when retaining anvil 20 is in uppermost position 68 (FIG. 6).

The dispensing opening extends between opposed side walls 30, 32. The napkins used in connection with dispenser 10 may be interfolded napkins, non-interfolded folded napkins, multi-fold napkins, and so forth. In many cases, non-interfolded napkins are used.

A method of dispensing napkins includes inserting a stack of napkins into the dispenser in a horizontal orientation as shown such that the edges of the napkins are presented to the dispensing aperture and withdrawing napkins manually from the dispenser. The dispenser thus provides a secure and clean environment for providing ready access to a fairly large volume of napkins as needed.

Advantageously, embodiments of the dispenser disclosed herein provide ready access to relatively large volumes of product that make it suitable for casual-dining commercial settings and the like where rapid distribution is an important consideration. Likewise, as is sufficient protection from drafts and contamination from spills or dust is also provided.

While the disclosure has been described with reference to an exemplary embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

What is claimed is:

1. A sheet product dispenser comprising:

(a) a housing defining:

(i) a vertically extending dispensing magazine for receiving a stack of horizontally disposed sheet products;

(ii) a dispensing opening vertically extending along the dispensing magazine such that edges of sheet products horizontally disposed in the dispensing magazine are exposed for dispensing through the dispensing opening;

(iii) an internal guide channel extending upwardly from the dispensing magazine; and (b) a sheet product retention member slidingly mounted in the housing adapted to rest upon the stack of sheet products and move downwardly under the influence of gravity as the sheet product stack is depleted, the sheet product retention member including:

(i) a platform; and (ii) a guide member extending upwardly from the platform and residing in the guide channel;

wherein the guide member and guide channel are configured to cooperate to guide upward and downward motion of the sheet product retention member;

wherein the guide member is tapered, such that the cross section of the guide member decreases with increasing height from the platform.

2. The sheet product dispenser according to claim 1, wherein the guide member has a front surface inclined away from the dispensing opening with increasing height from the platform.

3. The sheet product dispenser according to claim 2, wherein the guide channel of the housing and the sheet product retention member are configured such that the sheet product retention member may be installed in the housing or removed from the housing without disassembling the housing and without disassembling the sheet product retention member.

4. A sheet product dispenser comprising:

(a) a housing defining (i) a dispensing magazine vertically extending and having a generally rectangular cross-section, a pair of side walls and a bottom wall for receiving a stack of horizontally disposed sheet products;

(ii) a dispensing opening extending vertically upwardly from the bottom wall extending between the side walls of the dispensing magazine;

(iii) a guide channel extending upwardly from the dispensing magazine and;

(iv) a storage bin adjacent the guide channel of the housing, wherein the guide channel is located rearwardly with respect to the storage bin and separated therefrom by an inclined wall which extends upwardly with respect to the dispensing magazine and rearwardly toward a back wall of the dispenser; and (b) a sheet product retention member slidingly mounted in the housing adapted to rest upon the stack of sheet products and move downwardly under the influence of gravity as the sheet product stack is depleted, the sheet product retention member including:

(i) a generally rectangular platform; and (ii) a tapered guide member extending upwardly from the platform having a rearwardly inclined front surface residing in the guide channel of the housing, wherein the tapered guide member and guide channel are configured to cooperate to guide upward and downward motion of the sheet product retention member.

5. The sheet product dispenser according to claim 4, wherein the dispensing magazine internal cross section perimeter and platform perimeter are substantially identical.

6. The sheet product dispenser according to claim 4, wherein the guide member of the sheet product retention member has a generally rectangular cross section at its base which is substantially smaller than the cross section of the platform and is centrally located upon the platform; and wherein further the cross section of the guide member decreases with increasing height.

7. The sheet product dispenser according to claim 4, wherein the guide channel has substantially the same shape as the guide member such that the guide member mates with the guide channel in an uppermost position.

8. The sheet product dispenser according to claim 4, wherein the platform has a lower surface with a raised portion adjacent the dispensing opening.

9. The sheet product dispenser according to claim 4, wherein at least a portion of the housing is thermoformed or injection molded from a thermoplastic material.

10. The sheet product dispenser according to claim 4, wherein at least a portion of the sheet product retention member is thermoformed or injection molded from a thermoplastic material.

* * * * *